US005330000A

United States Patent [19]

Givens et al.

[11] Patent Number: 5,330,000

[45] Date of Patent: Jul. 19, 1994

[54] SQUEEZE PACKER LATCH

[75] Inventors: Kenneth J. Givens, Okotoks, Canada; Eric Stenzel, Duncan, Okla.; Donald Hushbeck, Duncan, Okla.; Kevin Bersheidt, Duncan, Okla.; Jerry T. Bohlen, Duncan, Okla.

[73] Assignee: Halliburton Company, Duncan, Okla.

[21] Appl. No.: 949,463

[22] Filed: Sep. 22, 1992

[51] Int. Cl.[5] ..... E21B 23/06

[52] U.S. Cl. ..... 166/134; 166/138; 166/210

[58] Field of Search ..... 166/278, 289, 363, 323, 166/322, 324, 214, 120, 134

[56] References Cited

U.S. PATENT DOCUMENTS

| | | | |
|---|---|---|---|
| 3,570,595 | 11/1968 | Berryman | 166/128 |
| 3,702,634 | 11/1972 | Anderson et al. | 166/386 |
| 3,827,258 | 8/1974 | Kammerer, Jr. et al. | 166/214 |
| 3,963,076 | 6/1976 | Winslow | 166/278 |
| 4,687,063 | 8/1987 | Gilbert | 166/386 |
| 4,751,967 | 6/1988 | Blandford et al. | 166/289 |
| 4,834,184 | 5/1989 | Streich et al. . | |

OTHER PUBLICATIONS

EZ Drill Squeeze Packers, Halliburton Services Sales & Service Catalog, 1990, pp. 146-147.

Baker Snap Latch Stinger Subs, Baker Service Tools Catalog, 1990, pp. 23, 23, 27.

*Primary Examiner*—Ramon S. Britts

*Assistant Examiner*—Frank S. Tsay

*Attorney, Agent, or Firm*—Arnold, White & Durkee

[57] ABSTRACT

A latching device to be used with a cement squeeze packer and a stinger is disclosed. The latching device enables an operator at the surface of an oil or gas well to open and close the squeeze packer valve without the risk of pulling the stinger out of the packer. The latch assembly is installed on the stinger assembly and is provided with a plurality of radially flexible fingers that engage the uphole end of the packer mandrel. Preferably, a series of ribs on both the latch and the uphole end of the mandrel are engaged when the stinger assembly descends into the hole and the stinger enters the packer. These ribs prevent the stinger from coming out of the packer until a predetermined tensile force is applied.

16 Claims, 4 Drawing Sheets

SQUEEZE PACKER LATCH

BACKGROUND OF THE INVENTION

1. Field of the Invention

This invention relates generally to squeeze cementing of oil or gas wells and, more specifically to a latching device between tubing and the squeeze packer assembly used for cementing an oil or gas well.

2. Description of the Related Art

Cementing is the term used for the process of placing a slurry, usually formed by combining a cementitious material with a liquid, into the annulus between the outside of the casing in the hole and the wall of the hole. Placement of cement is usually done by pumping. Squeeze cementing is the most common type of remedial (secondary) cementing. The process involves applying hydraulic pressure to force or squeeze a cement slurry in contact with a formation, either in open hole or through perforations in the casing or liner.

In many conditions a cement slurry may be applied to water, oil or gas bearing portions of a producing zone to eliminate excessive water or gas without sealing off the oil. This process is especially beneficial in correcting producing well defects. In addition, squeeze cementing may be used when an oil-producing zone is to be isolated from an adjacent gas zone, and the gas/oil ratio can usually be improved to help increase oil production. Additionally, water sands can be squeezed off below the oil sand to help improve water/oil ratios. Independent water zones can be squeezed to eliminate water intrusion. Further, a casing leak may be repaired by squeezing cement through the leak.

Additional applications of squeeze cementing include sealing low pressure zones that imbibe oil, gas or drilling fluids, overcoming channeling or insufficient annular fillup behind the casing, and protecting against fluid migration into a producing zone. Additionally, squeeze cementing is sometimes employed to seal off perforations or plug a depleted open hole producing zone. This helps prevent fluid migration to and from the abandoned zone.

The most effective methods of squeeze cementing, and the most widely applicable, are the packer method and the hesitation squeeze method. In the packer method, the interval to be squeezed is isolated from the surface by a packer run and set on tubing. Many types of packers are available, each designed for specific well conditions. Either retrievable or permanent (drillable) packers can be used. To isolate the section below the perforations to be squeezed, a drillable or retrievable bridge plug may be placed below the perforations. The upper perforations are then squeezed and the remaining slurry reversed out.

The hesitation method involves the placement of cement in a single stage, but divides the placement into alternate pumping/waiting periods. This hesitation practice utilizes controlled fluid loss properties of the slurry to build filter cake nodes against the formation and inside the perforations while the parent slurry remains in a fluid state in the casing.

Equipment commonly employed in squeeze cementing includes high pressure pumps, drillable type squeeze packers and bridge plugs, and retrievable type squeeze packers and bridge plugs. Bridge plugs provide a pressure and fluid boundary between sections of casing.

Multiple zones can be isolated individually for the desired treating or testing procedures.

Squeeze packers are designed to provide pressure or fluid control for remedial cementing operations. The squeeze packer tool may be used in conjunction with the work string tubular. Typically, a valve built in the squeeze packer tool helps hold cement in place by providing downhole pressure control. In addition to this control feature, the squeeze packer tool may be designed to be removed from the well by the use of common oil well drilling equipment and practices.

An example of a squeeze packer assembly is the "EZ DRILL SV®", which is a drillable squeeze packer available from Halliburton in various tool and casing size configurations Squeeze Packer from Halliburton Services of Duncan, Okla. Fluid movement through the EZ DRILL SV® Squeeze Packer is controlled with a pressure balanced sliding valve which is operated by axial reciprocation of the tubing. The valve may be opened or closed, if desired, before and after squeeze cementing. Fluid movement through the valve will not affect the valve's position. When the valve is in the closed position, the packer is sealed against fluid or gas movement in either direction. When the valve is in the open position, fluid may be pumped through the packer or pressure may be relieved from below it. An unrestricted flow passage is provided through side ports in the packer tool.

The EZ DRILL SV® Squeeze Packer may be set on tubing (drill pipe), electrical wire line or sand line. The packer may be converted for use as a bridge plug (no fluid movement in either direction through the tool) before running in the hole.

Thus, a squeeze packer assembly may be inserted downhole and the stinger end of the tubular inserted to open and close the valve in the packer as desired. However, when the stinger is pulled from the packer to close the valve, there is a risk that the stinger may be pulled completely out of the packer. This is a serious problem because the axial displacement of the tubular at the top of the hole may not correspond to the axial displacement where the stinger connects with the squeeze packer valve. One of the problems resulting from pulling the stinger out of the squeeze packer is the risk of cement leaking out which potentially could cement the tubing in the hole.

Therefore, a device is needed to prevent inadvertently pulling the stinger end of the tubular completely out of the squeeze packer. Attempts have been made to design a snap-in/snap-out type latch that provides a surface indication of the stinger being landed in the squeeze packer, giving assurance that the sleeve valve is open, or the stinger being removed from the packer, indicating the sleeve valve is closed. Such devices are intended to provide the operator with a positive indication that the control valve of the packer is in the closed or open position while the stinger remains locked in the retainer of the packer during testing of the tubing. One example of such a device is the snap-latch stinger subs available from Baker Service Tools. However, such latches have the disadvantage that internal mechanisms were required in the squeeze packer itself. The latch mechanism required modification to provide engagement members (such as teeth) on the inside of the mandrel, or engagement members on the stinger assembly itself. These modifications were disadvantages because they could not be easily applied to existing equipment.

SUMMARY OF THE INVENTION

The present invention overcomes the above problems and disadvantages by providing a latch mechanism that enables an operator at the surface of a well to open and close the squeeze packer valve without risking pulling the stinger out of the packer. The present invention increases the accuracy and reliability with which a squeeze packer may be used, and is particularly useful with the Halliburton EZ Drill SV ® Squeeze Packer.

The latch mechanism of the present invention may be installed on the tubular and held in place by a star guide or coupling on top and lugs or rings on the stinger at the bottom of the latch. As the assembly descends into the hole the stinger enters the squeeze packer mandrel. The latch has flexible fingers with inwardly facing ribs that flex out and snap into corresponding ribs in the uphole end of the mandrel as the stinger moves down inside the packer. When the stinger is pulled axially to close the valve, the latch retains the stinger in the packer. However, when a predetermined axial force is applied to the tubular, the latch will disengage from the packer mandrel.

DETAILED DESCRIPTION OF THE PREFERRED EMBODIMENT

Figure 1:
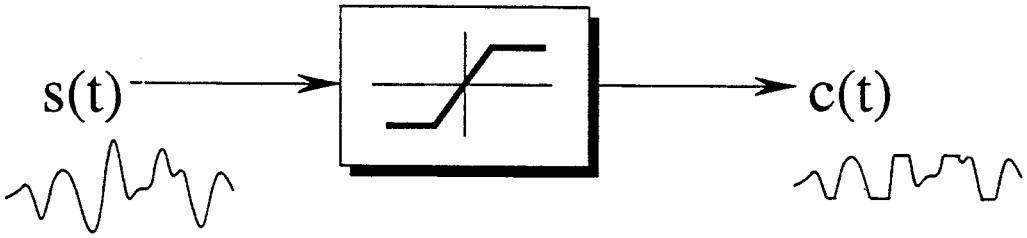
FIG. 1 is a cross section view of a preferred embodiment of the latch before it is engaged with the squeeze packer.

First referring to FIG. 1, a cross-section view of a preferred embodiment of latch 10 used in conjunction with squeeze packer 11 is shown. In FIG. 1 the latch 10 is disengaged from the squeeze packer 11. The squeeze packer is preferably an "EZ DRILL SV ®", which is a drillable squeeze packer available from Halliburton in various tool and casing size configurations Squeeze Packer from Halliburton Services of Duncan, Okla.

A tubular member (or work string) may be threaded to a star guide 20 which serves to centralize the tubular in the hole. Star guide 20 allows stinger 21 to be aligned with the mandrel 40 of squeeze packer 11. Squeeze packer 11 is set at the desired depth in the oil or gas well for use in cementing the well. The squeeze packer includes a mandrel 40 which is an elongated sleeve shaped member with radially directed apertures 41 adjacent the downhole end of the mandrel. These radially directed apertures 41 align with passages 45 in the lower slip support 44 of the squeeze packer, which terminates at junk catcher 46.

Squeeze packer 11 is provided with slips 29, 30 which may be urged radially outward from the squeeze packer to engage the well bore, by axial movement of wedges 26, 27. Wedges 26, 27 have angled faces to urge the slips 29, 30 radially outward against the well bore. Bolts 35, 43 are provided to keep wedges 26, 27 from moving around until the squeeze packer is set at the desired position in the hole. The slips 29, 30 are configured to pivot on upper and lower slip supports 33, 44. Upper slip support 33 includes lock ring housing 85 for lock ring 83 (which fits into a circumferential groove in the mandrel 40). Lock ring 83 locks upper slip support 33 and slip 29 against movement. Positioned axially between the wedges 26, 27 are packer rubbers 28. Also shown in FIG. 1 are packer shoes 80, 81 and wedge pins 39, 49 which hold the packer shoes in place.

The uphole end of the valve assembly 31 includes a plurality of fingers 48 which are flexible to engage flange 38 in the downhole end of stinger 21. Thus, the stinger may be gripped by the valve fingers 48 to provide axial reciprocal movement to open and close the valve. The stinger 21 may be sealed with the internal bore of the mandrel 40 with rubber seals 25.

The mandrel 40 is aligned with the valve assembly 31 by valve alignment bolt 42 which slides in an axial groove in finger 48 of the valve. Valve alignment bolt 42 slides along the groove to maintain the valve assembly 31 in alignment with the mandrel or sleeve 40. The valve assembly 31 slides axially within the mandrel 40, and is provided with a pair of O-rings 36 to seal on each side of the radial fluid passages 37, 41. When radially directed apertures 37 are axially positioned in alignment with apertures 41, the valve directs the slurry therethrough to cement the well bore.

Figure 4:
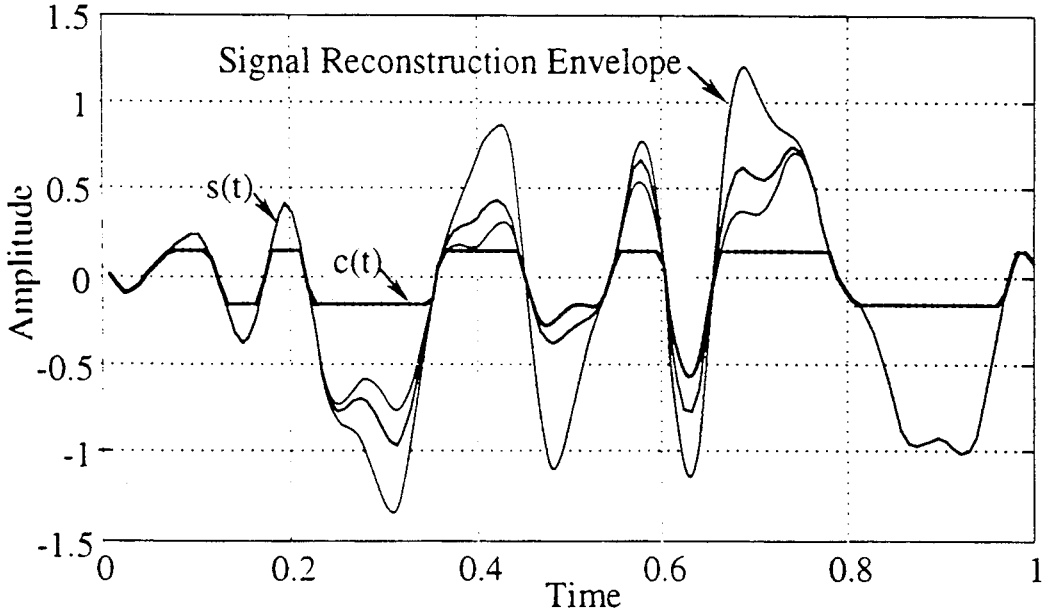
FIG. 4 is a cross section view of a preferred embodiment of the latch.
Figure 6:
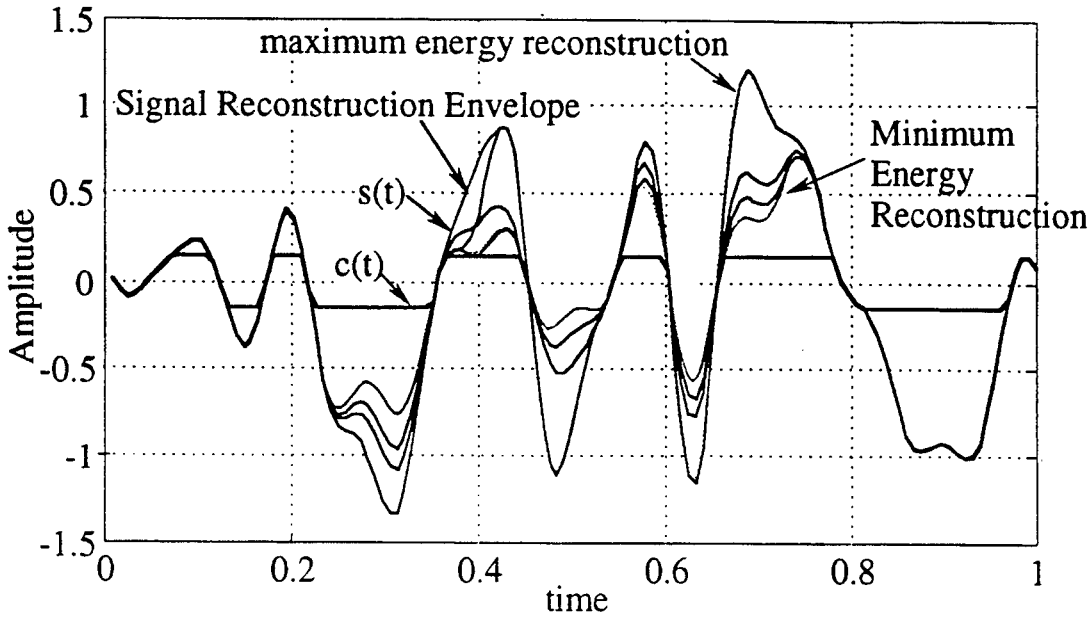
Figure 7:
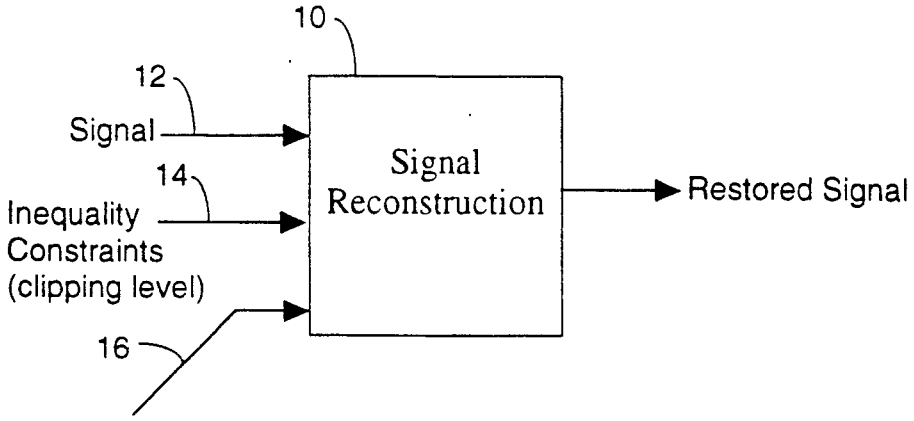
Figure 1:
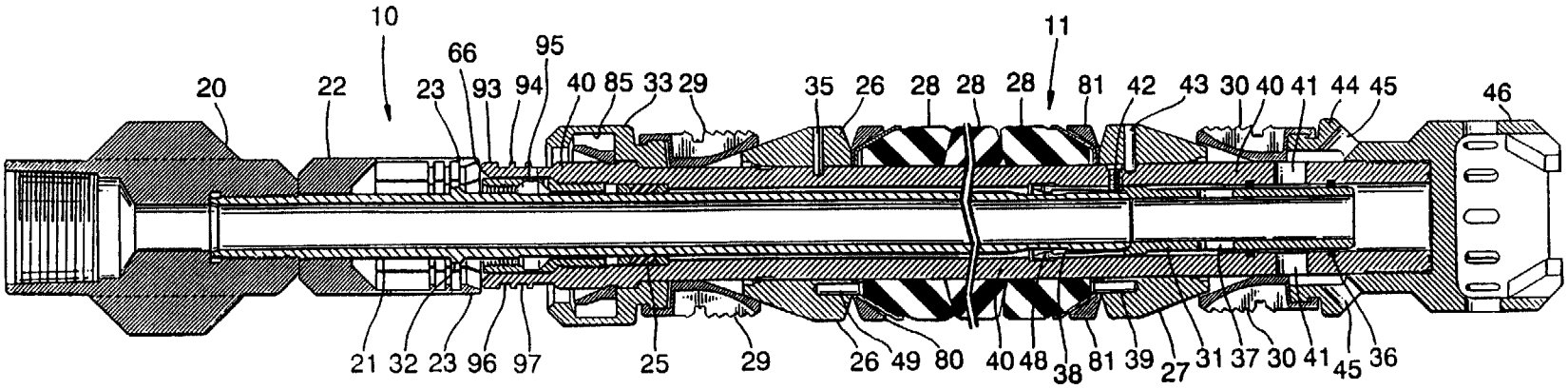
Figure 1A:
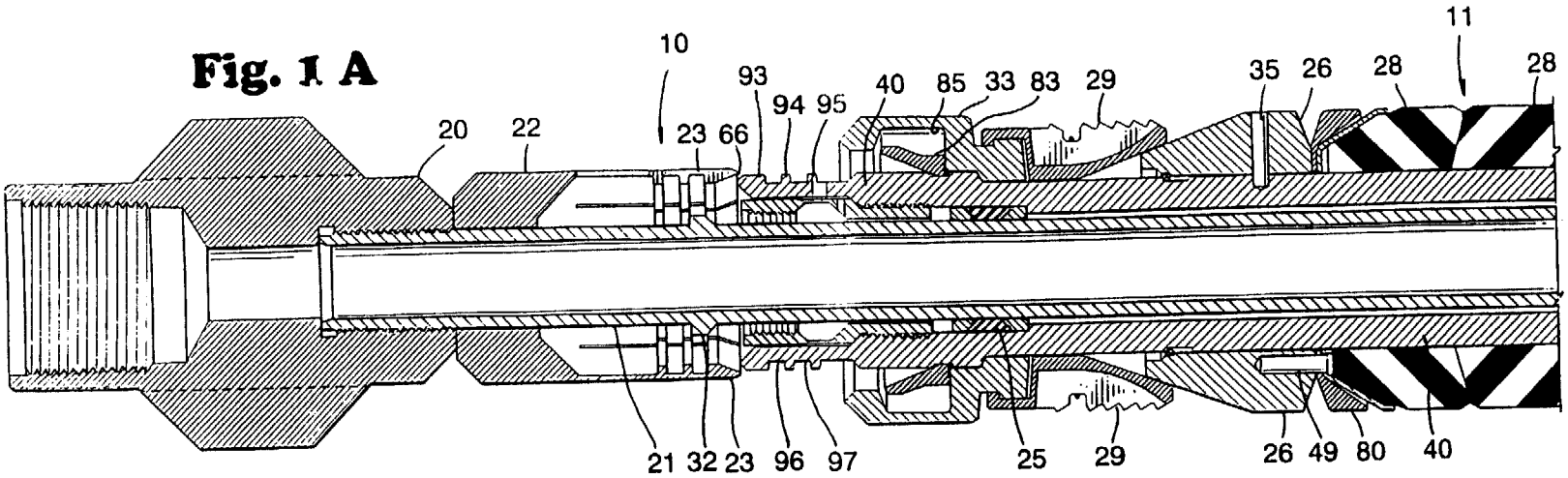
Figure 1B:
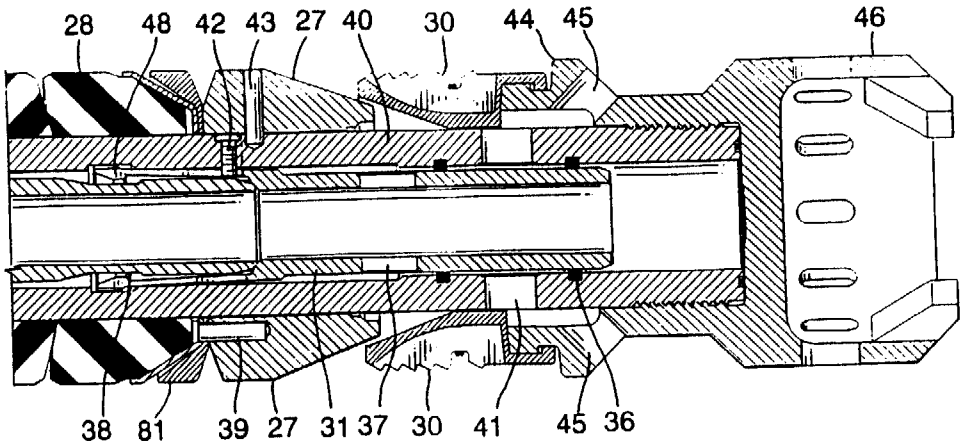
Figure 2A:
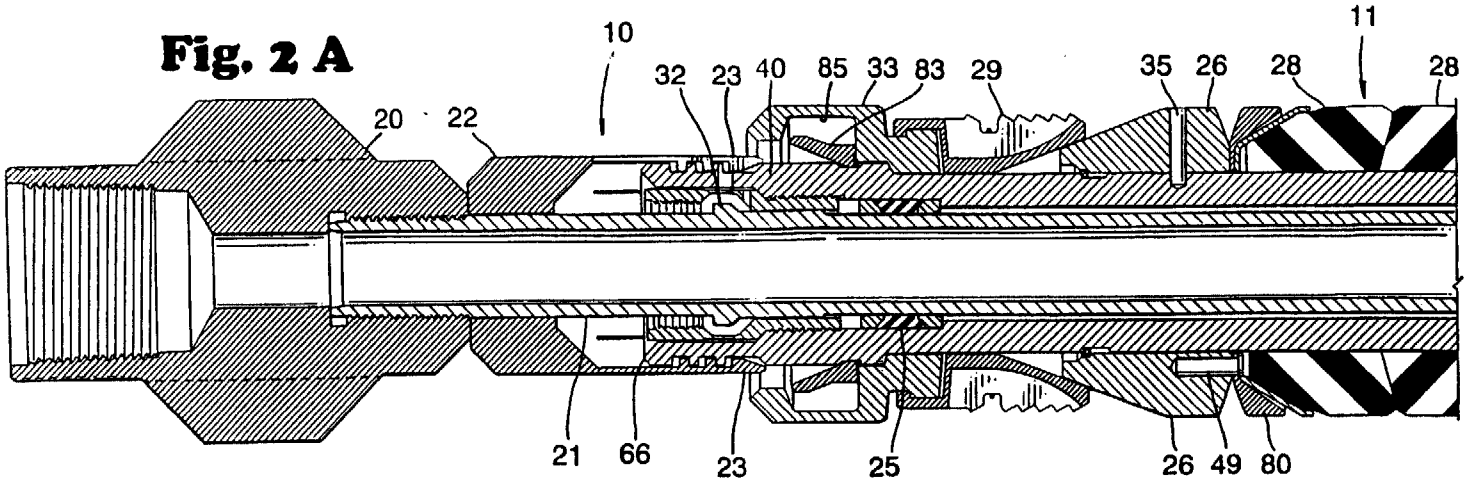
Figure 2B:
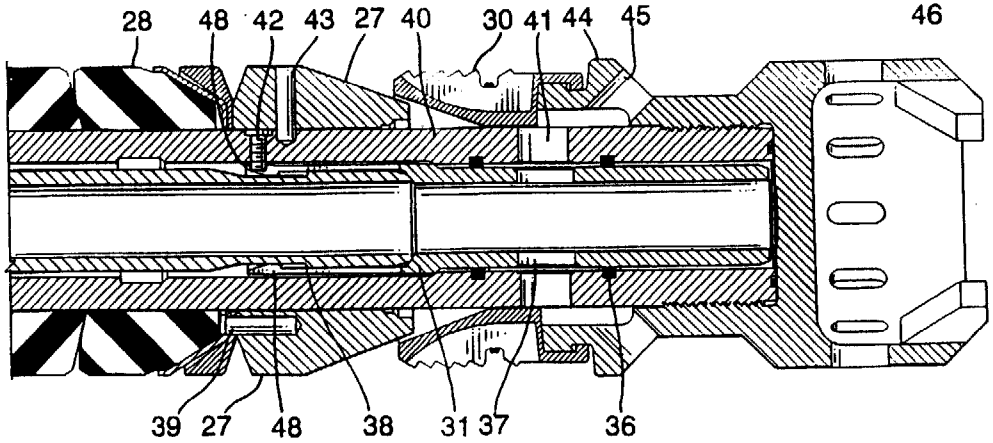
Figure 3A:
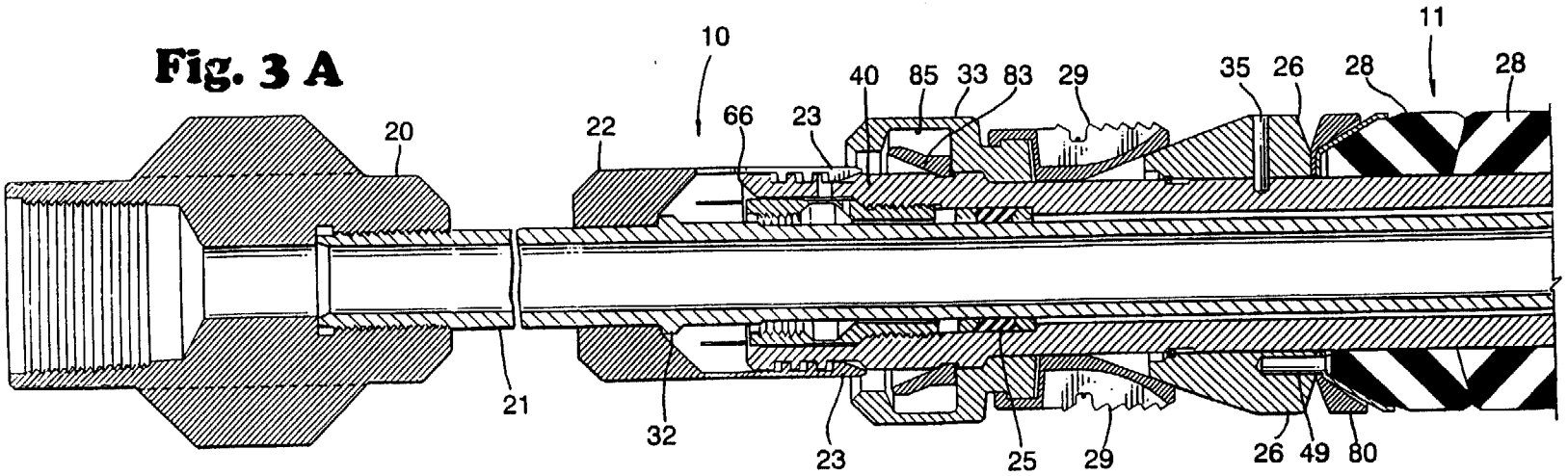
Figure 3B:
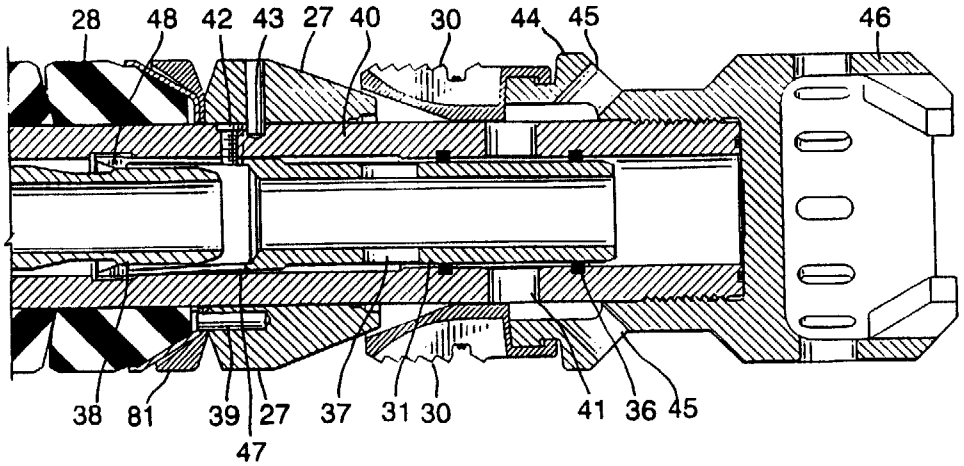
Figure 4:
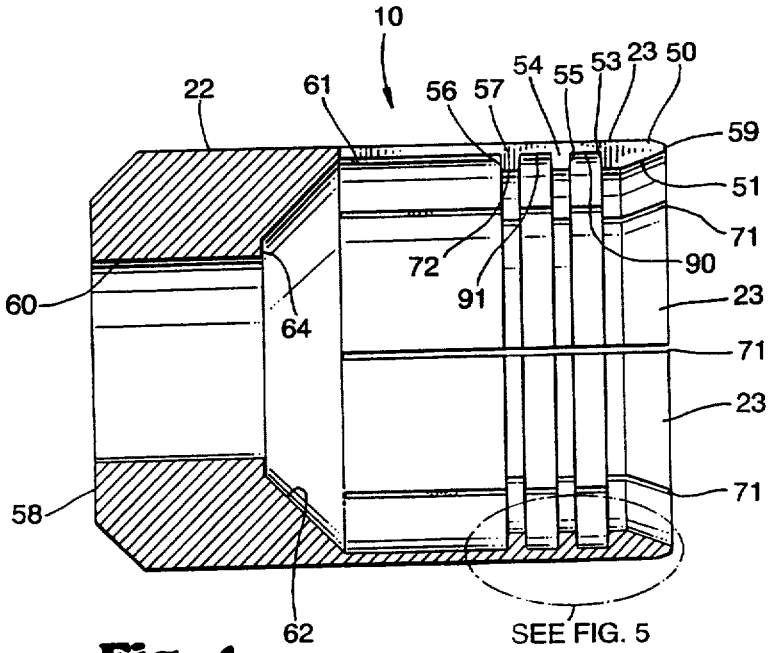
Figure 5:
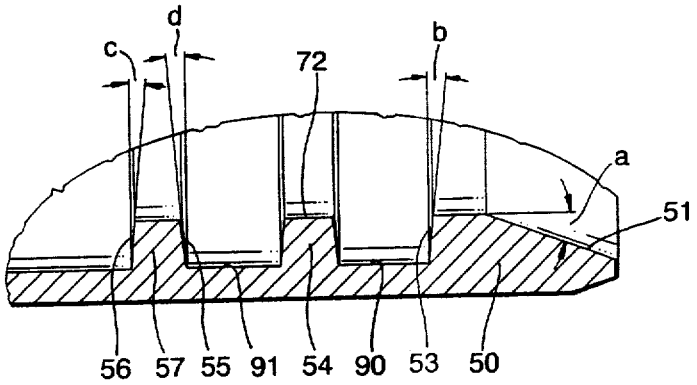

A preferred embodiment of the latch 10 of the present invention is shown in detail in FIG. 4. In a preferred embodiment, the latch is installed on stinger assembly 21 and is held in place on the uphole end of the latch by star guide 20, or alternatively a coupling. Lugs or rings 32 on the stinger secure the latch at its downhole end. The lugs or rings may be machined onto the outer circumferential surface of the stinger itself. The latch 10 preferably is configured to slide axially along the stinger between star guide 20 and lugs or rings 32.

The latch has a body 22 with a first end 58 and a second end 59. The first end 58 of the latch includes an internal bore 60 for insertion of the stinger assembly therethrough. From the first end 58, there is bore 60, shoulder 64, surface 62 (sloped at approximately 45 degrees) which expands radially outward, and bore 61. Bore 61 has a substantially larger diameter than bore 60.

In a preferred embodiment for use with $6\frac{5}{8}$ inch through $8\frac{5}{8}$ inch o.d. casing, bore 60 adjacent first end 58 has an i.d. of 1.81 inches, bore 61 adjacent the second end has an i.d. of 3.57 inches, and latch assembly body has an overall length 5.25 inches. In a preferred embodiment for use with $4\frac{1}{2}$ inch through 6 inch casing, bore 60 adjacent the first end has an i.d. of 1.56 inches, bore 61 adjacent the second end has an i.d. of 2.66 inches, and latch assembly body has an overall length of 4.90 inches.

In a preferred embodiment, the second end 59 of the latch 10 is split into fingers 23. Eight fingers are preferred for a latch used with $6\frac{5}{8}$ inch through $8\frac{5}{8}$ inch casing, while six fingers are preferred for a latch used with $4\frac{1}{2}$ through 6 inch casing. The radial thickness of each finger (as shown at reference number 61 in FIGS. 1–3) is between 0.10 and 0.15 inches with 0.10 being the most preferred. The radial thickness may be varied to provide a stronger latch which therefore will require greater tensile force to pull the stinger out of the packer. Each finger is separated by a slot 71 formed by a saw cut, preferably 0.06 inches in width and having a depth along the axis of the latch of approximately three inches. Thus, the axial length of each of the fingers 23 is more than half the overall length of the body 22 of the latch 10 used with either size casing.

Figure 5:
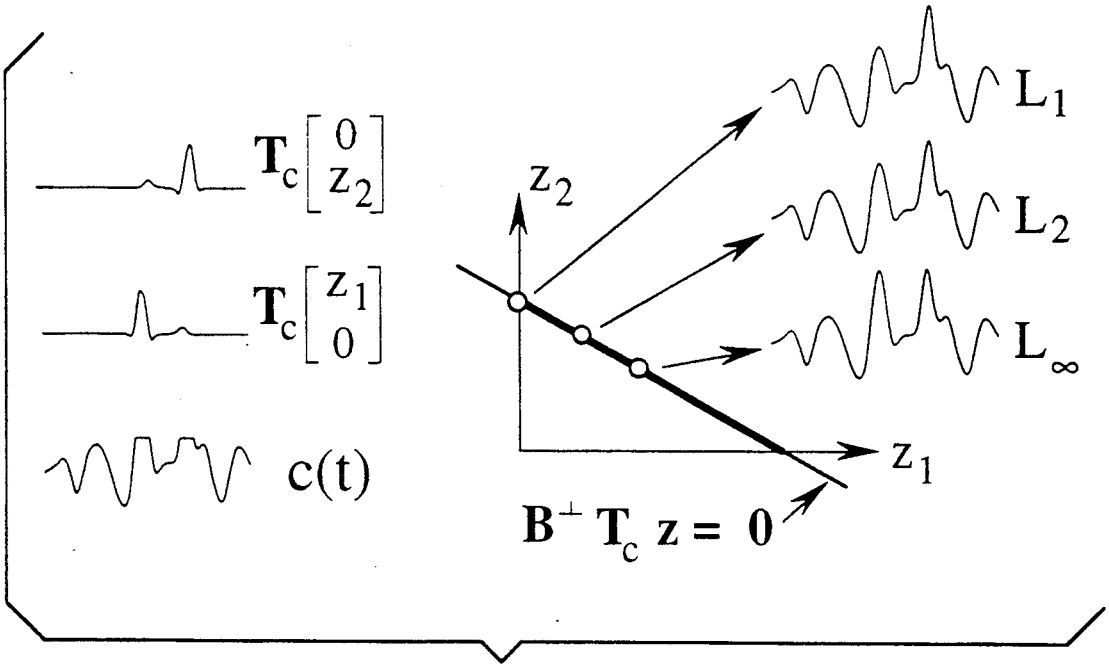
FIG. 5 is a detailed cross section view of a preferred embodiment of the engagement means used in the latch.

The engagement means of a preferred embodiment of the latch are shown in detail in FIGS. 4 and 5. As shown, the downhole end of the latch assembly has several inwardly facing ribs beginning at second end 59. Three ribs are preferred as the engagement means for a latch used with 6⅝ inch through 8⅝ inch casing, while two ribs are preferred for 4½ inch through 6 inch casing.

Although inwardly facing ribs are the preferred engagement means, it will be recognized that inwardly facing teeth or other engaging means may be used and is within the scope of the present invention.

Rib 50 adjacent the second end 59 of the latch has a beveled leading face 51 that has an angle a of 20 degrees. This angle helps cam the fingers radially outward to engage the latch with the packer. Rib 50 has a back face 53 having an angle b of 5 degrees from vertical. The embodiment for use with 6⅝ inch through 8⅝ inch casing includes a second rib 54 and a third rib 57, each rib having a crest 72, a front face 55 and a rear face 56. The front face preferably has an angle c which is 5 degrees from vertical, while the back face has an angle d, also at 5 degrees from vertical.

In a preferred embodiment, each rib has a height of between 0.15 and 0.155 inches. Each of the grooves 90, 91 (between each rib) has an axial width greater than each rib. In a preferred embodiment, grooves 90, 91 each have an axial width of 0.18 inch, while ribs 54, 57 each have an axial width of 0.15 inch.

As the stinger descends into the hole and enters the packer, the fingers 23 flare out and the engagement means snap into corresponding engagement means in the uphole end 66 of mandrel 40. Thus, in a preferred embodiment, the uphole end 66 of mandrel 40 is provided with ribs 93, 94, 95 and grooves 96, 97 which mate with the ribs and grooves of the latch.

The embodiment shown in FIG. 4 has eight fingers 23, which is preferred for the latch for use with 6⅝ through 8⅝ inch casing. The number of fingers may be varied depending on various factors, including the desired force to engage or disengage the latch. For example, when eight fingers are used in a latch for 6⅝ through 8⅝ inch casing, disengagement of the latch from the mandrel requires approximately 5,000 to 9,000 pounds of tensile force. When six fingers are used in latch for 4½ through 6 inch casing, disengagement of the latch from the mandrel requires approximately 4,000 to 8,000 pounds of tensile force. After repeated use, however, the tensile force for disengagement may drop substantially due to rounding off the corners of the ribs in the mandrel and latch. The mandrel ribs are preferably cast iron, while the latch is steel.

The tensile force to engage and disengage the latch from the mandrel also may be varied depending on the front and back face angles of each of the ribs. Thus, angles a, b, c, d may be increased or decreased depending on the tensile force desired to engage or disengage the latch from the mandrel.

When the tubular (or work string) is pulled uphole to close the valve, the latch prevents the stinger from coming out of the squeeze packer. However, when sufficiently great tensile force is applied to the tubular or work string, the latch will disengage from the mandrel and the stinger assembly may be pulled out of the squeeze packer.

Figure 2:
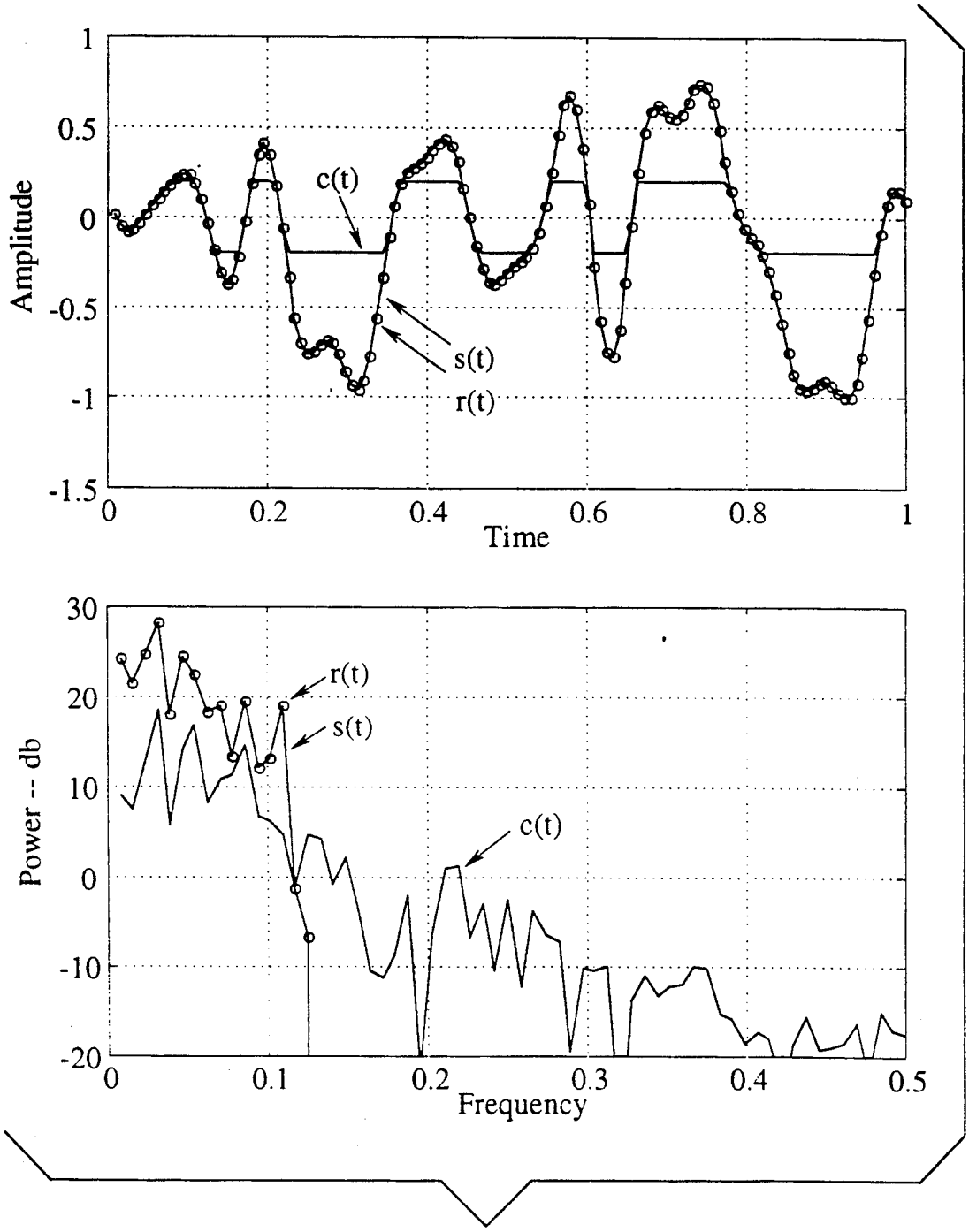
FIG. 2 is a cross section view of a preferred embodiment of the latch engaged with the squeeze packer, with the valve in the open position.

Now referring to FIG. 2, the latch 10 and squeeze packer 11 are shown with the latch engaged and the sliding valve 31 in the open position. The beveled surface 51 of rib 50 helps cam the fingers 23 radially outward to engage corresponding ribs and grooves in the uphole end of mandrel 40. The ribs and grooves of the latch 10 are engaged with corresponding ribs and grooves at the uphole end of the squeeze packer mandrel 40. As shown with valve 31 in the open position, the valve apertures 37 are aligned with apertures 41 in the mandrel 40.

Figure 3:
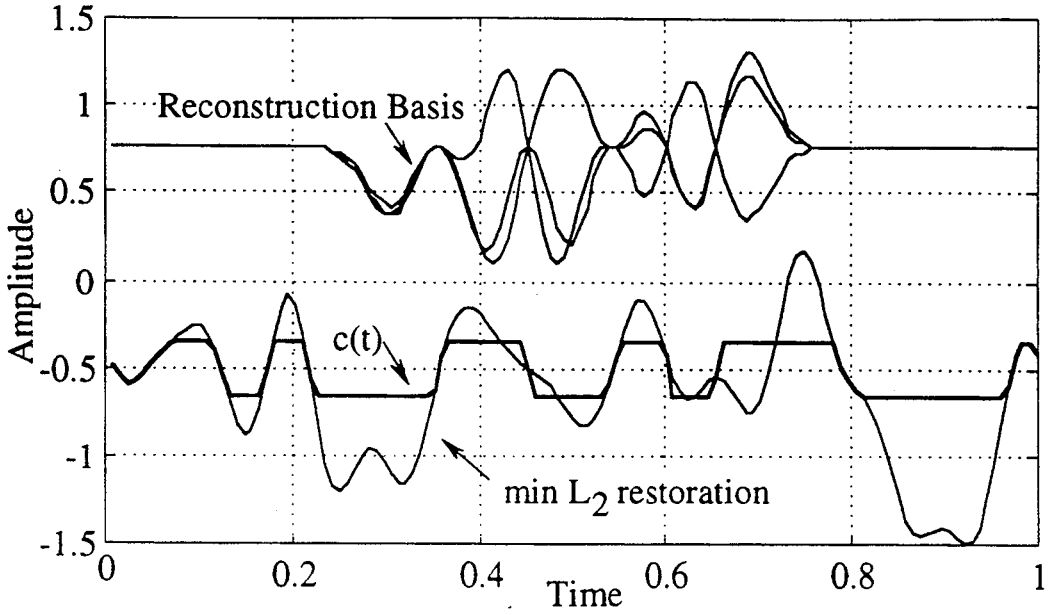
FIG. 3 is a cross section view of a preferred embodiment of the latch engaged with the squeeze packer, while the valve is in the closed position.

Now referring to FIG. 3, the stinger 21 has been partially withdrawn from the squeeze packer to close sliding valve 31. The flange 38 of the stinger has become partially disengaged from the fingers 48 of the uphole end 66 of the valve, while the stinger remains engaged with the squeeze packer. The valve apertures 37 are axially displaced with respect to apertures 41 in mandrel 40. O-rings 36 between the valve 31 and the mandrel 40 seal the passages to prevent leakage.

When stinger 21 is axially withdrawn to close sliding valve 31, the lugs or rings 32 abut the shoulder 64 of the latch. The latch 10 thus prevents further axial withdrawal of stinger 21 from the squeeze packer because the ribs and grooves of the latch are engaged with corresponding ribs and grooves in the mandrel 40. The axial width of the grooves is somewhat greater than the axial width of the ribs, so some axial shifting movement may occur. The ribs, however, remain engaged until the tensile force applied to the work string exceeds a predetermined value.

As mentioned above, one advantage of the present invention is that the stinger is prevented from completely disengaging the squeeze packer until a preselected tensile force is applied.

Another advantage of the present invention is that it does not require modification of the inside of the mandrel or significant modification of the stinger assembly itself. The latch assembly may be economically installed on existing downhole equipment.

Although variations in the embodiment of the present invention may not each realize all of the advantages of the invention, certain features may become more important than others in various applications of the device. The invention, accordingly, should be understood to be limited only by the scope of the appended claims.

What is claimed is:

1. An apparatus for retaining a tubular member in a valved squeeze packer, comprising:

(a) a sleeve-shaped member having a central axis and an internal bore along the central axis dimensioned to receive the tubular member therethrough, the sleeve-shaped member having a plurality of radially flexible fingers with inwardly facing ribs;

(b) means for limiting axial movement of the sleeve-shaped member between first and second axial positions with respect to the tubular member; and (c) a mandrel member attached to the valved squeeze packer and having outwardly facing ribs engageable with the inwardly facing ribs, the ribs of the mandrel member and sleeve-shaped member remaining engaged when the sleeve-shaped member is in the second axial position and tensile force on the tubular member is below a preselected force, and disengaging when the tensile force on the tubular member reaches a preselected force.

2. The apparatus of claim 1 wherein the ribs have front and back faces sloping 5 degrees from a plane perpendicular to the central axis of the sleeve-shaped member.

3. The apparatus of claim 1 wherein the mandrel member is provided with a sliding valve therein for selectively opening and closing ports in the mandrel member for transmission of a slurry therethrough; the tubular member engaging at least a portion of the valve to open and close the valve, the tubular member remaining engaged with the valve until said tensile force on the tubular member reaches said preselected force.

4. The apparatus of claim 1 wherein each of the fingers are separated by slots, each of the fingers having a width greater than the width of each of the slots.

5. The apparatus of claim 1 wherein each of the fingers has a tip, each tip having an inwardly facing bevelled surface.

6. The apparatus of claim 1 wherein each of the fingers has an axial length greater than one half the axial length of the sleeve-shaped member and not greater than the axial length of the sleeve-shaped member.

7. A latching device for preventing axial separation of a tubing from a cement-packing device in a subsurface well, the cement packing device having a mandrel at one end thereof with an outer circumference, comprising:

a substantially cylindrical body with a central axis and first and second ends and a bore extending along the central axis therethrough, the bore having an internal shoulder, the first end of the bore dimensioned to receive the tubing, the tubing provided with an abutment to contact the internal shoulder to limit axial movement of the body with respect to the tubing; the second end of the body having a plurality of inwardly facing engagement means for engaging the outer circumference of the mandrel of the cement-packing device, the second end of the body being radially flexible outwardly to disengage the outer circumference of the cement-packing device upon application of a predetermined tensile force to the tubing.

8. The latching device of claim 7 wherein the second end of the body comprises a plurality of radially flexible fingers separated by slots.

9. The latching device of claim 7 wherein the engagement means ia a plurality of inwardly facing ribs separated by grooves.

10. The latching device of claim 7 wherein the engagement means comprises a plurality of inwardly facing ribs, the rib nearest the second end of the body having a bevelled front face, each of the other ribs having front and back faces sloped at 5 degrees from a plane perpendicular to the central axis of the cylindrical body.

11. The latching device of claim 9 wherein the axial width of each rib is less than the axial width of the groove between each rib.

12. An apparatus for latching a stinger to a cement squeeze packer, comprising:

(a) a substantially cylindrical body having a central axis and slidably attached to the outer circumference of the stinger and having an internal bore for receiving the stinger therethrough;

(b) means to limit axial movement of the body with respect to the stinger;

(c) a mandrel extending from the uphole end of the cement packer for receiving the stinger therethrough, the mandrel having an internal slidable valve openable upon axial extension of the downhole end of the stinger towards the valve, and closeable upon axial withdrawal of the downhole end of the stinger away from the valve; and (d) a plurality of ribs on the outer circumference of the mandrel and the internal bore of the body, the ribs on the mandrel and body mutually engaging upon axial movement of the stinger into the mandrel, the ribs remaining engaged until axial application of a tensile force to the stinger exceeds a preselected force.

13. The apparatus of claim 12 wherein the internal bore in the body has a first end dimensioned to receive the stinger in sliding engagement, and a second end partitioned to form a plurality of fingers, at least some of the fingers having internally facing ribs.

14. The apparatus of claim 12 wherein the internal slidable valve includes a plurality of radially flexible fingers separated by axial slots, the fingers flexing radially to engage and disengage the downhole end of the stinger.

15. The apparatus of claim 12 wherein the ribs in the internal bore of the body comprise a first rib with a bevelled internally sloping surface facing the downhole end of the body, and at least one additional rib having surfaces sloping at 5 degrees from a plane perpendicular to the central axis of the cylindrical body, facing both the uphole an downhole ends of the body.

16. The apparatus of claim 12 wherein the internal bore is split into at least six fingers separated by axial slots, the fingers being substantially wider than the slots.

* * * * *

UNITED STATES PATENT AND TRADEMARK OFFICE

CERTIFICATE OF CORRECTION

PATENT NO. : 5,330,000

DATED : July 19, 1994

INVENTOR(S) : Kenneth J. Givens, et al

It is certified that error appears in the above-indentified patent and that said Letters Patent is hereby corrected as shown below:

The title page, showing an illustrative figure, should be deleted and substitute therefor the attached title page.

In the drawings, sheet 1-4, consisting of Figs. 1-7, should be deleted to be replaced with sheets 1-5, consisting of Figs. 105, as shown on the attached pages.

Signed and Sealed this

First Day of November, 1994

Bruce Lehman

*Attest:*

BRUCE LEHMAN

*Attesting Officer*

*Commissioner of Patents and Trademarks*

United States Patent [19]

Givens et al.

[11] Patent Number: 5,330,000

[45] Date of Patent: Jul. 19, 1994

[54] SQUEEZE PACKER LATCH

[75] Inventors: Kenneth J. Givens, Okotoks, Canada; Eric Stenzel, Duncan, Okla.; Donald Hushbeck, Duncan, Okla.; Kevin Bersheidt, Duncan, Okla.; Jerry T. Bohlen, Duncan, Okla.

[73] Assignee: Halliburton Company, Duncan, Okla.

[21] Appl. No.: 949,463

[22] Filed: Sep. 22, 1992

[51] Int. Cl.[5] ..... E21B 23/06

[52] U.S. Cl. ..... 166/134; 166/138; 166/210

[58] Field of Search ..... 166/278, 289, 363, 323, 166/322, 324, 214, 120, 134

[56] References Cited

U.S. PATENT DOCUMENTS

| | | | |
|---|---|---|---|
| 3,570,595 | 11/1968 | Berryman | 166/128 |
| 3,702,634 | 11/1972 | Anderson et al. | 166/386 |
| 3,827,258 | 8/1974 | Kammerer, Jr. et al. | 166/214 |
| 3,963,076 | 6/1976 | Winslow | 166/278 |
| 4,687,063 | 8/1987 | Gilbert | 166/386 |
| 4,751,967 | 6/1988 | Blandford et al. | 166/289 |
| 4,834,184 | 5/1989 | Streich et al. . | |

OTHER PUBLICATIONS

EZ Drill Squeeze Packers, Halliburton Services Sales & Service Catalog, 1990, pp. 146–147.

Baker Snap Latch Stinger Subs, Baker Service Tools Catalog, 1990, pp. 23, 23, 27.

*Primary Examiner*—Ramon S. Britts

*Assistant Examiner*—Frank S. Tsay

*Attorney, Agent, or Firm*—Arnold, White & Durkee

[57] ABSTRACT

A latching device to be used with a cement squeeze packer and a stinger is disclosed. The latching device enables an operator at the surface of an oil or gas well to open and close the squeeze packer valve without the risk of pulling the stinger out of the packer. The latch assembly is installed on the stinger assembly and is provided with a plurality of radially flexible fingers that engage the uphole end of the packer mandrel. Preferably, a series of ribs on both the latch and the uphole end of the mandrel are engaged when the stinger assembly descends into the hole and the stinger enters the packer. These ribs prevent the stinger from coming out of the packer until a predetermined tensile force is applied.

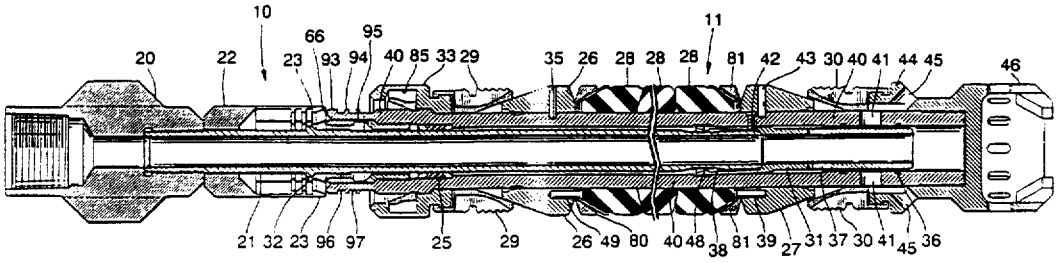

16 Claims, 5 Drawing Sheets